US009506185B2

(12) United States Patent
Choi et al.

(10) Patent No.: US 9,506,185 B2
(45) Date of Patent: Nov. 29, 2016

(54) LAUNDRY TREATING APPARATUS

(71) Applicant: LG ELECTRONICS INC., Seoul (KR)

(72) Inventors: Junghoi Choi, Seoul (KR); Jaemyung Lim, Seoul (KR); Jeaseok Seong, Seoul (KR); Byeongkook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/182,737

(22) Filed: Feb. 18, 2014

(65) Prior Publication Data

US 2014/0238086 A1 Aug. 28, 2014

(30) Foreign Application Priority Data

Feb. 28, 2013 (KR) ..... 10-2013-0021848

(51) Int. Cl.

*D06F 58/20* (2006.01)
*D06F 58/24* (2006.01)
*D06F 58/12* (2006.01)

(52) U.S. Cl.

CPC ..... *D06F 58/24* (2013.01); *D06F 58/12* (2013.01); *D06F 58/20* (2013.01); *D06F 58/203* (2013.01); *D06F 58/206* (2013.01)

(58) Field of Classification Search

CPC ..... D06F 58/24
See application file for complete search history.

(56) References Cited

U.S. PATENT DOCUMENTS

2008/0148493 A1 6/2008 Hong et al.
2010/0058608 A1 3/2010 Moon et al.
2010/0088919 A1 4/2010 Yang et al.
2012/0017654 A1 1/2012 Park et al.

FOREIGN PATENT DOCUMENTS

| | | | |
|---|---|---|---|
| CN | 101517151 | A | 8/2009 |
| CN | 201627096 | U | 11/2010 |
| DE | 20 2006 000 337 | | 6/2007 |
| EP | 2 514 865 | A1 | 10/2012 |
| JP | 2000-051588 | A | 2/2000 |
| JP | 2000-093698 | A | 4/2000 |
| JP | 2005-329104 | A | 12/2005 |
| KR | 10-2011-0127426 | A | 11/2011 |
| WO | WO 2007/126225 | A1 | 11/2007 |

(Continued)

OTHER PUBLICATIONS

UK Office Action dated Jun. 30, 2014 issued in Application No. GB1403585.1.

(Continued)

*Primary Examiner* — Jason Ko
(74) *Attorney, Agent, or Firm* — Ked & Associates, LLP

(57) ABSTRACT

A laundry treating apparatus is disclosed. The laundry treating apparatus includes a laundry support unit provided in a receiving space, in which laundry is received, to support the laundry and a machinery compartment located at a bottom of the receiving space to define a space separated from the receiving space, the machinery compartment being provided with at least one selected from between an air supply unit to supply air to the receiving space and a water supply unit to supply water to the receiving space. The machinery compartment has a smaller width than the receiving space to define a space to receive the laundry held by the laundry support unit between an outer circumference of the machinery compartment and an inner circumference of the receiving space.

15 Claims, 10 Drawing Sheets

(56) References Cited

FOREIGN PATENT DOCUMENTS

| | | | |
|---|---|---|---|
| WO | WO 2007/133004 | A1 | 11/2007 |
| WO | WO 2008/013382 | A2 | 1/2008 |

OTHER PUBLICATIONS

Chinese Office Action dated Oct. 10, 2015 issued in Application No. 201410072671.9.

German Office Action dated Aug. 31, 2016 issued in Application No. 10 2014 101 931.8 (with English translation).

(a)

(b)

(a)

(b)

(a)

(b)

(a)

(b)

LAUNDRY TREATING APPARATUS

This application claims the benefit of Korean Patent Application No. 10-2013-0021848, filed on Feb. 28, 2013, which is hereby incorporated by reference as if fully set forth herein.

BACKGROUND OF THE INVENTION

Field of the Invention

The present invention relates to a laundry treating apparatus.

Discussion of the Related Art

Generally, a laundry treating apparatus performs various operations for laundry (washes, dries, deodorizes, and removes wrinkles from the laundry). The laundry treating apparatus includes a washing machine to wash laundry, a drying machine to dry wet laundry, and a refresher to deodorize or remove wrinkles from laundry.

Meanwhile, the laundry treating apparatus has been developed to wash, dry, deodorize, and remove wrinkles from laundry.

However, the laundry treating apparatus includes a drum to receive laundry and a drive device to rotate the drum. For this reason, the laundry treating apparatus is not sufficient to deodorize or remove wrinkles from laundry.

That is, in the conventional laundry treating apparatus, generally, laundry is deodorized or wrinkles are removed from the laundry during rotation of the drum. Furthermore, the laundry is placed in the drum in a wrinkled state. As a result, it is not possible to sufficiently deodorize or remove wrinkles from the laundry.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that is capable of easily drying, deodorizing, removing wrinkles from, and sanitizing laundry.

Another object of the present invention is to provide a laundry treating apparatus having a receiving space to receive laundry having different lengths.

A further object of the present invention is to provide a laundry treating apparatus that is capable of preventing damage to laundry and reducing power consumption.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus includes a cabinet having a receiving space to receive laundry, a laundry support unit provided in the receiving space to support the laundry, and a machinery compartment provided as a space separated from the receiving space, the machinery compartment being provided with at least one selected from between an air supply unit to supply air to the receiving space and a water supply unit to supply water to the receiving space, wherein the machinery compartment divides the receiving space into two spaces configured such that at least one of height and width of one of the spaces is different from that of the other space.

In another aspect of the present invention, a laundry treating apparatus includes a cabinet having a receiving space to receive laundry, a laundry support unit provided in the receiving space to support the laundry, and a machinery compartment provided as a space separated from the receiving space, the machinery compartment being provided with at least one selected from between an air supply unit to supply air to the receiving space and a water supply unit to supply water to the receiving space, wherein the machinery compartment defines the bottom of the receiving space such that a step is formed at the bottom of the receiving space.

In another aspect of the present invention, a laundry treating apparatus includes a cabinet having a receiving space to receive laundry, a laundry support unit provided in the receiving space to support the laundry, and a machinery compartment located at a bottom of the receiving space to define a space separated from the receiving space, the machinery compartment being provided with at least one selected from between an air supply unit to supply air to the receiving space and a water supply unit to supply water to the receiving space, wherein the machinery compartment has a smaller width than the receiving space to define a space to receive the laundry held by the laundry support unit between an outer circumference of the machinery compartment and an inner circumference of the receiving space.

The air supply unit may include a circulation duct provided in the machinery compartment to circulate air in the receiving space, an evaporator provided in the circulation duct to dehumidify air introduced into the circulation duct, a condenser provided in the circulation duct to heat the air having passed through the evaporator, and a compressor provided outside the circulation duct to circulate a refrigerant along the evaporator and the condenser.

The compressor and the circulation duct may be stacked in a height direction of the machinery compartment.

The laundry treating apparatus may include an air suction unit, provided at a rear of the machinery compartment such that the air suction unit communicates with the circulation duct, through which air from the receiving space is introduced into the circulation duct, and an air discharge unit, provided at a rear of the machinery compartment such that the air discharge unit communicates with the circulation duct, through which the air is discharged from the circulation duct.

The water supply unit may include a storage unit provided in the machinery compartment to store water, a heater provided in the storage unit, and a water supply pipe to interconnect an interior of the storage unit and an interior of the receiving space.

The laundry treating apparatus may further include a machinery compartment door to open and close the machinery compartment, wherein the machinery compartment door may include a door body to open and close the machinery compartment and a water supply tank provided at the door body such that, when the door body closes the machinery compartment, the water supply tank is coupled to the storage unit to supply water to the storage unit.

The storage unit may be provided in a space defined between the compressor and the door body.

The storage unit, the circulation duct, and the compressor may be stacked in the height direction of the machinery compartment.

The machinery compartment door may further include a drainage tank provided at the door body and the water supply unit may further include a residual water discharge unit configured such that, when the machinery compartment door closes the machinery compartment, the residual water discharge unit is connected to the drainage tank to discharge water stored in the storage unit to the drainage tank.

The water supply tank may further include a water supply tank window provided in a height direction of the water supply tank such that a water level of the water supply tank can be checked through the water supply tank window, the drainage tank may further include a drainage tank window provided in a height direction of the drainage tank such that a water level of the drainage tank can be checked through the drainage tank window, and the door body may further include a body through hole provided at a position corresponding to the water supply tank window and the drainage tank window.

The laundry treating apparatus may further include a condensed water collection unit to supply condensed water stored in the circulation duct to the storage unit.

The laundry treating apparatus may further include an auxiliary receiving space, having a smaller height than the machinery compartment, provided in a space defined between an outer circumference of the machinery compartment and an inner circumference of the receiving space to provide a storage space.

The laundry treating apparatus may further include an air suction unit provided at one selected from between a rear of the machinery compartment and a rear of the auxiliary receiving space and an air discharge unit provided at the other selected from between the rear of the machinery compartment and the rear of the auxiliary receiving space, wherein the air supply unit may include a circulation duct provided to interconnect the air suction unit and the air discharge unit and a heat exchange unit provided in the circulation duct to dehumidify and heat air introduced into the circulation duct.

The heat exchange unit may include an evaporator provided in the circulation duct to dehumidify air in the circulation duct, a condenser provided in the circulation duct to heat air, and a compressor provided outside the circulation duct to circulate a refrigerant along the evaporator and the condenser, and the compressor may be provided above or below the circulation duct.

The laundry support unit may be reciprocatingly provided in the receiving space.

In another aspect of the present invention, a laundry treating apparatus includes a cabinet having a receiving space to receive laundry, a laundry support unit provided in the receiving space to support the laundry, and a machinery compartment provided as a space separated from the receiving space, the machinery compartment being provided at an interior thereof with an air supply unit to supply air to the receiving space, an air suction unit to guide the air from the receiving space to the air supply unit, and an air discharge unit to discharge the air supplied by the air supply unit into the receiving space, wherein the air suction unit and the air discharge unit are provided at a bottom of the receiving space and the bottom of the receiving space are bent such that the air suction unit and the air discharge unit are located at different heights.

In a further aspect of the present invention, a laundry treating apparatus includes a cabinet having a receiving space to receive laundry, a laundry support unit provided in the receiving space to support the laundry, and a machinery compartment provided as a space separated from the receiving space, the machinery compartment being provided at an interior thereof with at least one selected from between an air supply unit to supply air to the receiving space and a water supply unit to supply water to the receiving space, and an auxiliary receiving space provided in a space defined between an outer circumference of the machinery compartment and an inner circumference of the receiving space to provide a storage space, wherein a surface of the machinery compartment and a surface of the auxiliary receiving space define a bottom of the receiving space and the machinery compartment and the auxiliary receiving space are provided such that the machinery compartment and the auxiliary receiving space have different heights.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. It should be noted herein that construction of an apparatus, which will hereinafter be described, and a control method of the apparatus are given only for illustrative purposes and the protection scope of the invention is not limited thereto. Wherever possible, the same reference numbers will be used throughout the drawings to refer to the same or like parts.

A laundry treating apparatus according to the present invention may be an example of an apparatus that dries, deodorizes, and removes wrinkles from laundry as well as a refresher that refreshes the laundry.

Refresh may mean a process of supplying air, heated air, water, mist, or steam to laundry to remove wrinkles from, deodorize, sanitize, prevent static electricity from, or dry the laundry.

In addition, the term "the laundry" mentioned in this specification means articles, such as shoes, socks, gloves, hats, and mufflers, which people wear and articles, such as dolls, towels, and bedclothes, which people use as well as clothes and apparel. That is, the laundry includes all articles that can be washed.

Figure 1:
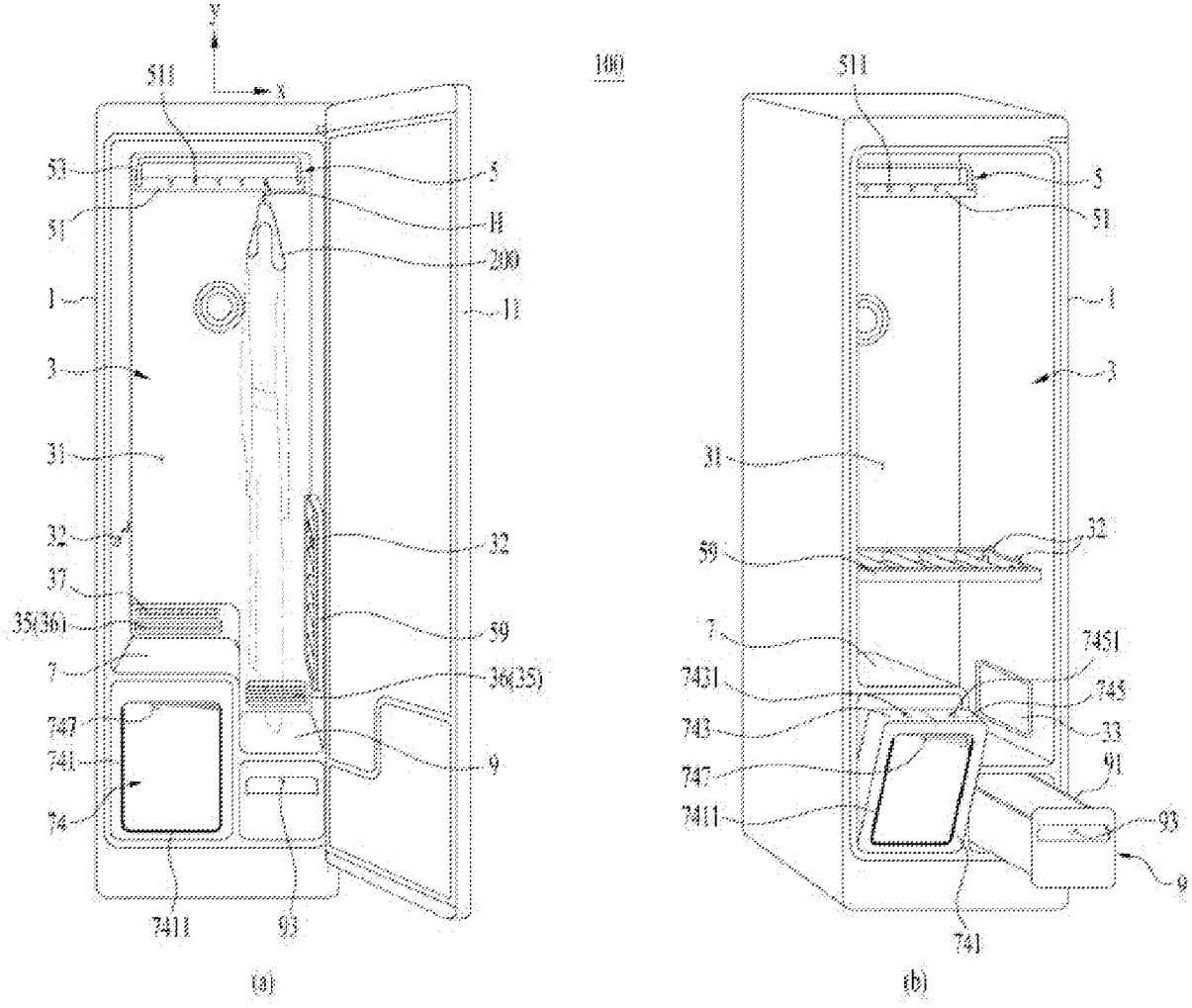
FIG. 1 is a view showing a laundry treating apparatus according to an embodiment of the present invention.

Referring to FIG. 1, a laundry treating apparatus 100 according to an embodiment of the present invention includes a cabinet 1 forming the external appearance thereof, a laundry receiving unit 3 provided in the cabinet 1 to receive laundry, a laundry support unit 5 to hold laundry in the laundry receiving unit 3, and a machinery compartment 7, in which at least one selected from between a device (air supply unit) to supply air (heated air or unheated air) into the laundry receiving unit 3 and a device (water supply unit) to supply water (steam or mist) into the laundry receiving unit 3 is provided.

Hereinafter, the laundry treating apparatus 100 configured such that both the air supply unit and the water supply unit are provided in the machinery compartment 7 will be described for the convenience of description.

The laundry receiving unit 3 includes a receiving space 31 provided in the cabinet 1. The receiving space 31 is opened and closed by a door 11 provided at the cabinet 1.

The receiving space 31 is provided with an air discharge unit 35 to supply air into the receiving space 31, an air suction unit 36 to discharge air from the receiving space 31 into the machinery compartment 7, and a water discharge unit 37 to supply water into the receiving space 31.

The air discharge unit 35 and the air suction unit 36 are connected to an air supply unit 71 (see FIG. 5) provided in the machinery compartment 7 and the water discharge unit 37 is connected to a water supply unit 72 (see FIG. 5) provided in the machinery compartment 7, which will hereinafter be described in detail.

Meanwhile, the laundry receiving unit 3 may be provided with a perfume unit 33 to supply a perfume material into the receiving space 31. As shown in FIG. 1(*b*), the perfume unit 33 may be provided at the inner circumference of the receiving space 31.

In this case, the perfume unit 33 may include a perfume material storage unit (not shown) depressed in the inner circumference of the receiving space 31 to store a perfume material and a perfume unit door (not shown) hinged to the receiving space 3 to open and close the perfume material storage unit.

The perfume unit door (not shown) may be provided with a plurality of through holes (not shown), through which the perfume material storage unit (not shown) communicates with the outside. This is because, in a case in which the perfume material can be sublimed, the perfume material stored in the perfume material storage unit can be supplied into the receiving space 31 through the through holes (not shown).

Meanwhile, although not shown, the laundry receiving unit 3 may be further provided with a sanitizing unit to sanitize the laundry stored in the receiving space 31 by applying ultraviolet light to the laundry and a deodorizing unit to deodorize the laundry stored in the receiving space 31.

The laundry support unit 5 provided in the receiving space 31 may include a rack 59 detachably provided in the receiving space 31 and a moving hanger MH movably provided in the receiving space 31 to move the laundry.

In this case, the laundry receiving unit 3 may further include a rack support unit 32 provided in the receiving space 31 such that the rack 59 is detachably provided in the receiving space 31.

The rack support unit 32 is provided at each side of the inner circumference of the receiving space 31. A plurality of rack support units 32 may be provided in the receiving space 31.

The rack 59 is held by any one of the rack support units 32 provided at the opposite sides of the receiving space 31 such that the rack 59 is fixed to the inner circumference of the receiving space 31 (see FIG. 1(*a*)). As needed, the outer circumference of the rack 59 is supported by the rack support units 32 such that the rack 59 holds laundry (see FIG. 1(*b*)).

Meanwhile, the rack 59 may be configured to have a structure in which air and water supplied into the receiving space 31 can reach the laundry held by the rack 59. That is, the rack 59 may include a frame coupled to the rack support units 32 and a plurality of bars fixed to the frame while being spaced apart from one another by a predetermined distance.

The moving hanger MH includes a hanger bar 51 having receiving grooves 511, in each of which a hook H of a clothes hanger 200 is received, and a support bar 53 to support opposite ends of the hanger bar 51.

In this case, the support bar 53 extends through the upper end of the receiving space 31. The support bar 53 is formed of an elastic material. The opposite ends of the hanger bar 51 are connected to the support bar 53 such that the hanger bar 51 is located in the receiving space 31.

Meanwhile, the moving hanger MH may further include a drive unit to reciprocate the hanger bar 51 in the receiving space 31. The term 'reciprocation' means movement of the hanger bar 51 in an x-z plane as well as reciprocation of the hanger bar 51 along an x-axis or a z-axis.

Although a concrete driving example of the drive unit is not disclosed in this specification, the drive unit may be configured to reciprocate the hanger bar 51 along a y-axis.

Figure 2:
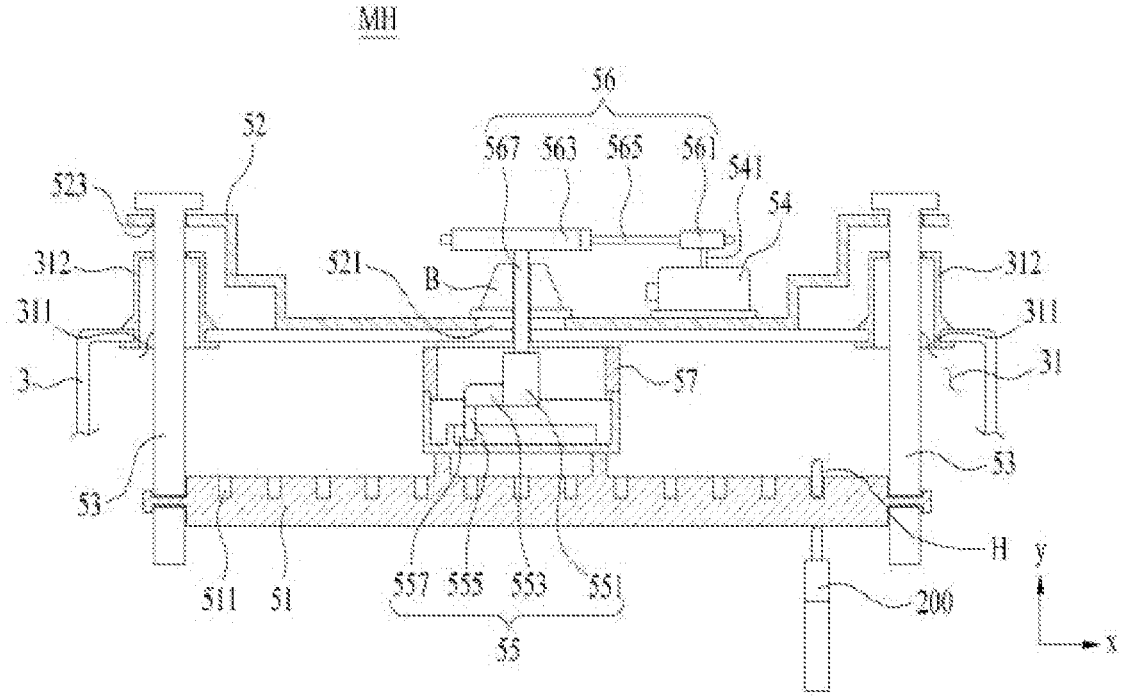
FIGS. 2 to 4 are views showing a moving hanger provided in the laundry treating apparatus according to the embodiment of the present invention.

As shown in FIG. 2, the drive unit may include a motor 54 to provide rotational power, a power conversion unit 55 to convert the rotational power provided by the motor 54 into horizontal reciprocation of the hanger bar 51, a power transmission unit 56 to transmit the rotational power provided by the motor 54 to the power conversion unit 55, and a support frame 52 provided outside the receiving space 31 to support the respective components as described above.

The support frame 52 is provided with a support bar fixing hole 523, in which the support bar 53 is fixed. Consequently, one end of the support bar 53 is fixed in the support bar fixing hole 523 and the other end of the support bar 53 is located in the receiving space 31 through a receiving space through hole 311 provided at the top of the receiving space 31.

Meanwhile, in order to prevent water or air supplied into the receiving space 31 from being discharged out of the receiving space 31 through the receiving space through hole 311, a sealing member may be further provided in the receiving space through hole 311.

Figure 3:
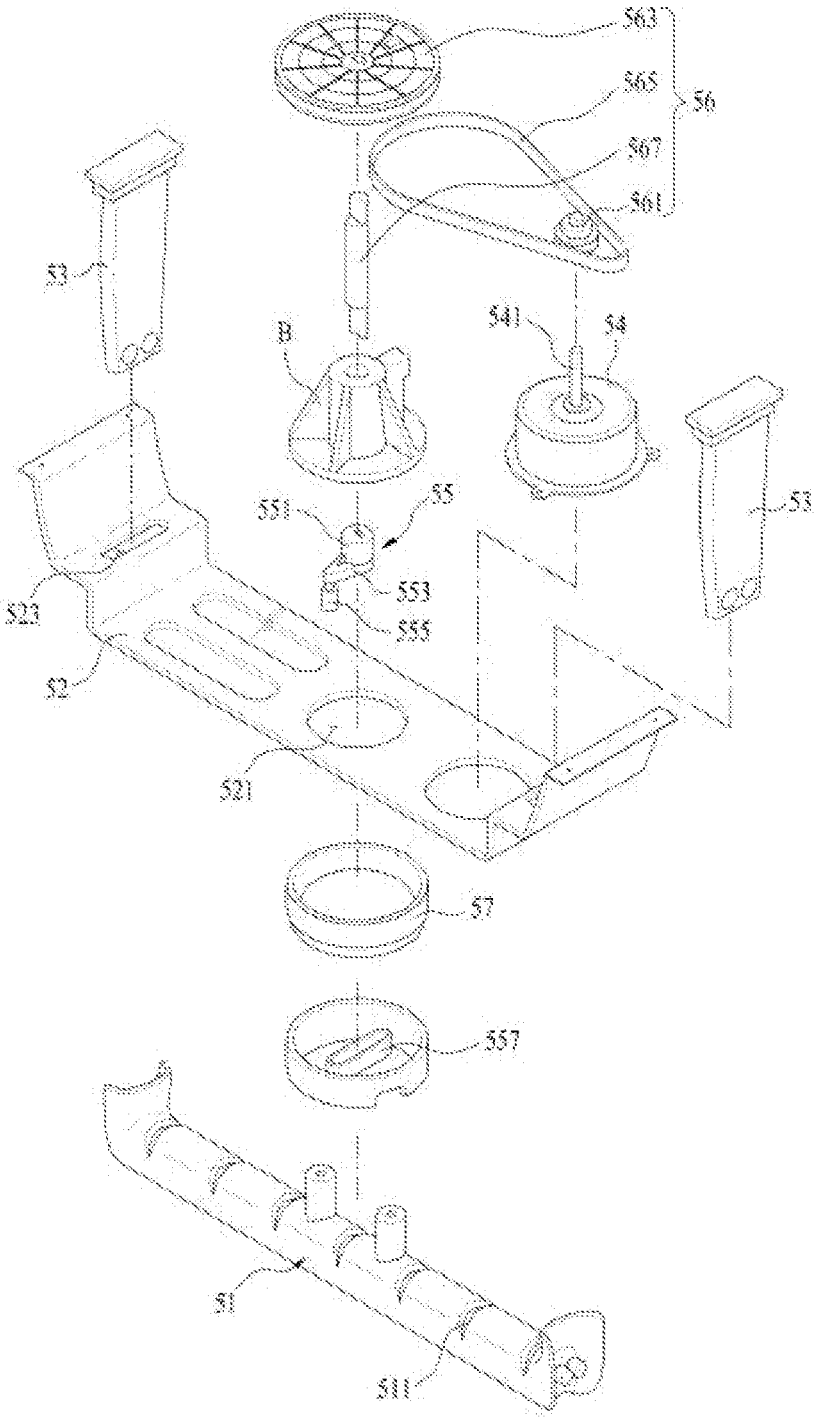

As shown in FIG. 3, the power transmission unit 56 may include a driving pulley 561 coupled to a rotary shaft 541 of the motor 54, a driven pulley 563 connected to the driving pulley 561 via a belt 565 or a chain, and a rotary shaft 567 coupled to the center of the driven pulley 563.

The rotary shaft 567 is rotatably supported by a bearing housing B fixed to the support frame 52.

Meanwhile, the power conversion unit 55 may include a shaft coupling part 551 coupled to the rotary shaft 567, a rotary arm 553 extending from the shaft coupling part 551 in a direction perpendicular to the rotary shaft 567, a slot insertion part 555 provided at one end of the rotary arm 553 such that the slot insertion part 555 is rotated about the rotary shaft 567, and a slot 557 provided at the hanger bar 51 such that the slot insertion part 555 is received in the slot 557.

In this case, the rotary arm 553 and the slot insertion part 555 are inserted through a conversion unit through hole 521 provided at the support frame 52. In addition, the rotary arm 553 and the slot insertion part 555 are inserted into the slot 557 located in the receiving space 31 through the top of the receiving space 31.

The slot 557 may be provided in parallel to the longitudinal direction of the hanger bar 51 or perpendicular to the longitudinal direction of the hanger bar 51.

In a case in which the slot 557 is provided in parallel to the longitudinal direction of the hanger bar 51, the hanger bar 51 may reciprocate along the z-axis of FIG. 2. On the other hand, in a case in which the slot 557 is provided perpendicular to the longitudinal direction of the hanger bar 51, as shown in FIG. 4, the hanger bar 51 may reciprocate along the x axis of FIG. 2.

Meanwhile, the moving hanger MH may further include a conversion unit cover 57 to prevent the power conversion unit 55 from being exposed outside.

In the moving hanger with the above-stated construction, when the motor 54 is driven, the driven pulley 563 is rotated with the result that the rotary shaft 567 coupled to the driven pulley 563 is also rotated. Consequently, the slot insertion part 555 may perform circular motion, having a radius equivalent to the length of the rotary arm 553, about the shaft coupling part 551.

Figure 4:
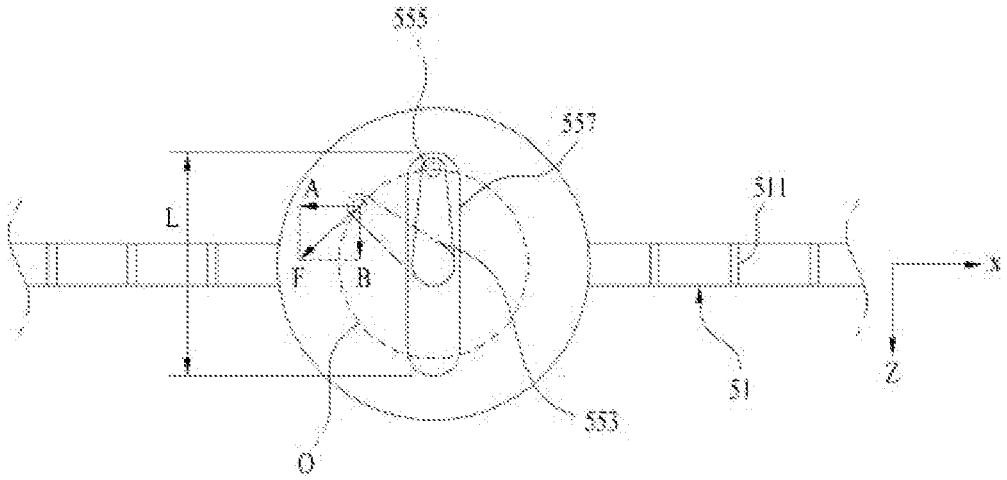

As shown in FIG. 4, the slot 557 provided at the hanger bar 51 may be provided perpendicular to the longitudinal direction of the hanger bar 51. The slot 557 may have a length L equivalent to or greater than the diameter of a rotational track O of the slot insertion part 555.

In this case, the slot 557 reciprocates along the x-axis although the slot insertion part 555 performs circular motion. Consequently, the hanger bar 51, to which the slot 557 is fixed, may reciprocate in the receiving space 31.

That is, the slot insertion part 555 of the power conversion unit 55 performs circular motion along the rotational track O due to the rotational power provided by the motor 54 and the slot 557 is moved only by a portion of the force F provided by the slot insertion part 555, e.g. a force component A parallel to the hanger bar 51. Consequently, the hanger bar 51 coupled to the slot 557 reciprocates along the x-axis.

Meanwhile, the length L of the slot 557 may be less than the diameter of the rotational track O of the slot insertion part 555. In this case, the hanger bar 51 may reciprocate in the x-z plane.

In the structure of the moving hanger MH as described above, the rotational power from the motor 54 is transmitted to the hanger bar 51 via the power transmission unit 56. Alternatively, the rotational power from the motor 54 may be directly transmitted to the hanger bar 51. In this case, the shaft coupling part 551 of the power conversion unit 55 may be directly coupled to the rotary shaft 541 of the motor 54.

Furthermore, the power transmission unit 56 may transmit the rotational power from the motor 54 to the power conversion unit 55 via the driving gear coupled to the rotary shaft 541 of the motor 54 and the driven gear, to which the rotary shaft 567 is fixed, coupled to the driving gear.

Meanwhile, the machinery compartment 7 is separated from the receiving space 31 such that the device to supply water or air into the receiving space 31 is disposed in the machinery compartment 7.

As shown in FIG. 1, the machinery compartment 7 is located at the bottom of the receiving space 31. The machinery compartment 7 has a width (length in the x-axis direction) less than that of the receiving space 31.

This is because it is necessary to define a space to receive laundry held by the hanger bar 51 between the outer circumference of the machinery compartment 7 and the inner circumference of the receiving space 31.

Consequently, the machinery compartment 7 may be provided at a corner at which the inner circumference of the receiving space 31 and the bottom of the receiving space 31 intersect such that the width of the machinery compartment 7 is less than that of the receiving space 31.

Alternatively, the machinery compartment 7 may be provided to define the bottom of the receiving space 31 such that two spaces having different heights and/or widths are defined in the receiving space 31. In this case, laundry having different lengths may be received in the receiving space 31.

That is, in a case in which the surface of the machinery compartment 7 is provided to interconnect the opposite sides of the receiving space 31 such that the machinery compartment 7 defines the bottom of the receiving space 31, the surface of the machinery compartment 7 may be bent such that the surface of the machinery compartment 7 has different heights.

In this case, the air discharge unit 35 and the air suction unit 36 may be provided at the bottom of the receiving space 31 (surface of the machinery compartment 7) such that air discharge unit 35 and the air suction unit 36 are located at different heights.

Meanwhile, an auxiliary receiving space 9 having a height less than the height of the machinery compartment 7 (length of the machinery compartment 7 in the y-axis direction) may be further provided in a space defined between the outer circumference of the machinery compartment 7 and the inner circumference of the receiving space 31.

The auxiliary receiving space 9 provides a storage space to store laundry, accessories necessary to treat the laundry, shoes, etc. As shown in FIG. 1, the auxiliary receiving space 9 may include a drawer 91 disposed below the bottom of the receiving space 31 and a drawer handle 93.

In this case, the bottom of the receiving space 31 is defined by the surface of the machinery compartment 7 and the surface of the auxiliary receiving space 9. Since the height of the auxiliary receiving space 9 is less than that of the machinery compartment 7, however, laundry having different lengths may be received in the receiving space 31.

Hereinafter, the structure of the machinery compartment 7 provided in the laundry treating apparatus according to the embodiment of the present invention will be described in detail with reference to FIG. 5.

At least one selected from between an air supply unit 71 to supply air into the receiving space 31 and a water supply unit 72 to supply water into the receiving space 31 is provided in the machinery compartment 7. Hereinafter, a description will be given of the laundry treating apparatus configured such that both the air supply unit 71 and the water supply unit 72 are provided in the machinery compartment 7.

The air supply unit 71 supplies heated air (hot air) or unheated air into the receiving space 31.

In a case in which the air supply unit 71 is provided to supply unheated air into the receiving space 31, the air supply unit 71 includes a circulation duct 711 and a blower 715.

On the other hand, in a case in which the air supply unit 71 is provided to supply hot air into the receiving space 31, the air supply unit 71 includes a circulation duct 711 to provide a flow channel along which air in the receiving space 31 circulates, a heat exchange unit 713 to dehumidify and heat air introduced into the circulation duct 711, and a blower 715 provided in the circulation duct 711 to circulate air in the receiving space 31.

Any one selected from between the air suction unit 36 and the air discharge unit 35 is provided at the top of the machinery compartment 7 and the other selected from between the air suction unit 36 and the air discharge unit 35 is provided at the top of the auxiliary receiving space 9.

The height of the auxiliary receiving space 9 is less than that of the machinery compartment 7. In a case in which the air discharge unit 35 is provided at the top of the auxiliary receiving space 9, therefore, air may be supplied to laundry located in a space defined between the side of the machinery compartment 7 and the inner circumference of the receiving space 31.

The air suction unit 36 and the air discharge unit 35 are provided at the rear of the machinery compartment 7 and the rear of the auxiliary receiving space 9 (a corner at which the rear wall of the receiving space 31 and the top of the machinery compartment 7 intersect and a corner at which the rear wall of the receiving space 31 and the top of the auxiliary receiving space 9 intersect), respectively.

The air suction unit 36 and the air discharge unit 35 are disposed adjacent to each other so as to enable easy cleaning of the air suction unit 36 and the air discharge unit 35.

In addition, in a case in which the air suction unit 36 and the air discharge unit 35 are disposed adjacent to the rear wall of the receiving space 31, air discharged through the air discharge unit 35 may be prevented from being condensed on the surface of the door 11.

The circulation duct 711 is provided to interconnect the air suction unit 36 and the air discharge unit 35. To this end, the circulation duct 711 may extend through the machinery compartment 7 and the auxiliary receiving space 9.

Meanwhile, in a case in which the heat exchange unit 713 includes a heat pump, the heat exchange unit 713 may include an evaporator E provided in the circulation duct 711 to evaporate a refrigerant, a condenser C provided in the circulation duct 711 to condense the refrigerant, a compressor P provided outside the circulation duct 711 to circulate the refrigerant along the evaporator E and the condenser C via a refrigerant pipe 714, and an expansion device Ex provided in the refrigerant pipe 714.

The blower 715 may be disposed between the condenser C and the air discharge unit 35. In this case, negative pressure is generated at the rear of the condenser C with the result that air in the circulation duct 711 may easily exchange heat with the evaporator E and the condenser C.

In a case in which the blower 715 is disposed between the air suction unit 36 and the evaporator E, the blower 715 generates positive pressure between the air suction unit 36 and the evaporator E such that air is supplied to the evaporator E.

Flow rate of the circulation duct 711 per unit sectional area may not be uniform according to the shape of the circulation duct 711 due to the positive pressure generated between the air suction unit 36 and the evaporator E. However, the flow rate of the circulation duct 711 per unit sectional area may be relatively uniform due to the negative pressure generated between the condenser C and the air discharge unit 35. For this reason, the blower 715 is disposed between the condenser C and the air discharge unit 35.

Meanwhile, the evaporator E, the condenser C, and the blower 715 may be provided in the circulation duct 711 located in the machinery compartment 7 such that the heat exchange unit 713 is easily maintained. That is, in a case in which a machinery compartment rear door (not shown) communicating with the interior of the machinery compartment 7 is provided at the rear of the machinery compartment 7 and a duct door (not shown), through which a user may access the evaporator E, is provided at the circulation duct 711, the heat exchange unit 713 may be easily repaired or replaced.

The evaporator E and the condenser C disposed in the circulation duct 711 are connected to the compressor P via the refrigerant pipe 714 and the refrigerant circulates along the evaporator E and the condenser C via the refrigerant pipe 714 and the compressor P.

The compressor P is provided outside the circulation duct 711. Since the compressor P has the largest volume among the respective components constituting the heat exchange unit 713, the height and the width of the machinery compartment 7 may be set such that the machinery compartment 7 has the minimum volume required to receive the compressor P.

Consequently, other devices (for example, the water supply unit 72) having heights less than that of the compressor P may be disposed in the inner space of the machinery compartment 7 around the compressor P.

Since the other devices disposed in the machinery compartment 7 have heights less than that of the compressor P although the height and the width of the machinery compartment 7 are set such that the machinery compartment 7 has the minimum volume to receive the compressor P, the water supply unit 72 or the circulation duct 711 may be disposed in the machinery compartment 7 around the compressor P. In the laundry treating apparatus 100 according to the embodiment of the present invention, therefore, the height and the width of the machinery compartment 7 may be minimized.

In addition, when the width of the machinery compartment 7 is minimized, a space to receive laundry is provided between the side of the machinery compartment 7 and the inner circumference of the receiving space 31. In the laundry treating apparatus 100 according to the embodiment of the present invention, therefore, long laundry, such as coats, may be received in the receiving space 31, the height of which is relatively small.

The water supply unit 72 supplies steam or mist into the receiving space 31. Hereinafter, the water supply unit 72 that supplies steam into the receiving space 31 will be described by way of example.

The water supply unit 72 may include a storage unit 721 located in front of the compressor P to store water, a heater 725 (see FIG. 7) to heat the water stored in the storage unit 721, and a water supply pipe 727 to supply steam generated in the storage unit 721 to the water discharge unit 37.

The water discharge unit 37 is provided at the top of the machinery compartment 7 to supply water (steam) into the receiving space 31. The water discharge unit 37 may also be provided at the rear of the machinery compartment 7 (the corner at which the top of the machinery compartment 7 and the rear wall of the receiving space 31 intersect).

This allows the water discharge unit 37 to be easily cleaned and prevents steam from condensing on the surface of the door 11.

Figure 5:
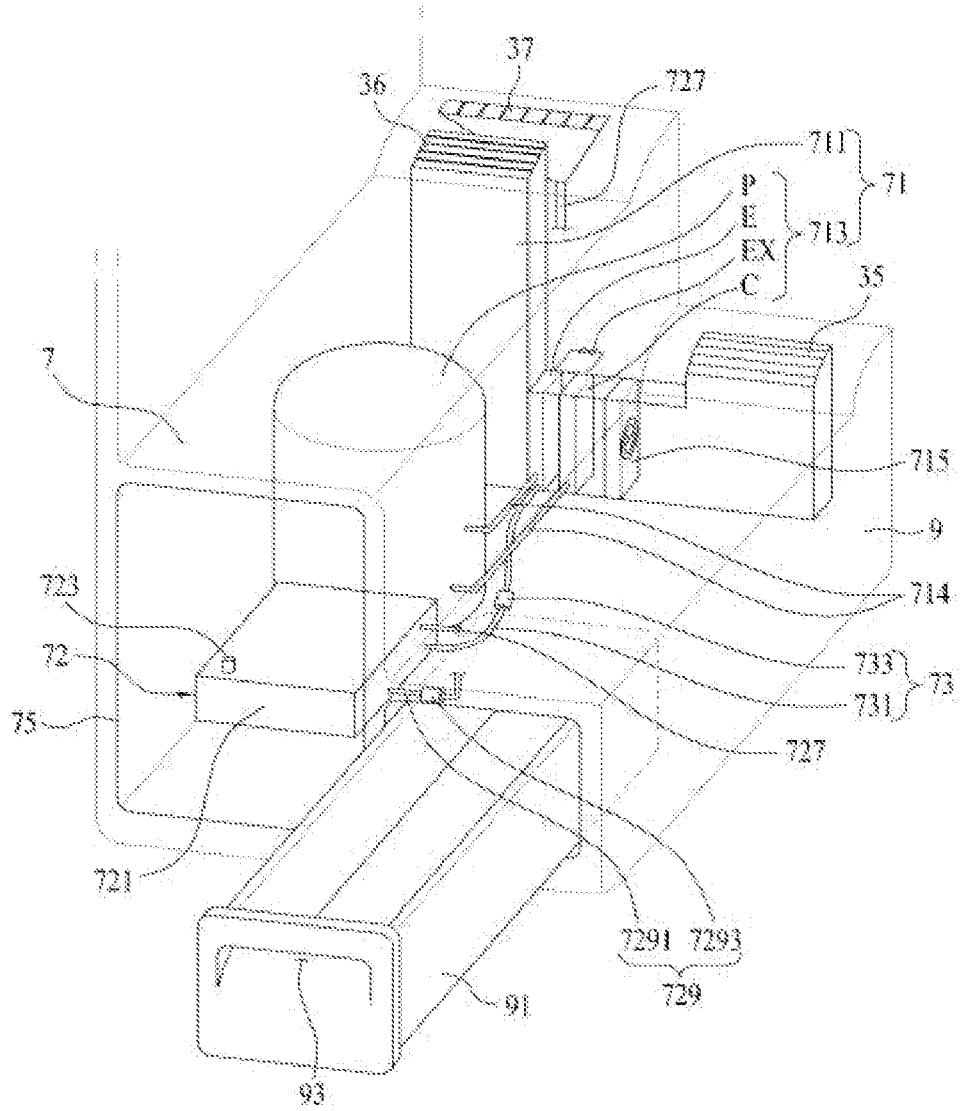
FIG. 5 is a view showing internal structures of a machinery compartment and an auxiliary receiving space provided in the laundry treating apparatus according to the embodiment of the present invention.

However, the water discharge unit 37 may be provided at the top of the auxiliary receiving space 9 unlike what is shown in FIG. 5.

Figure 6:
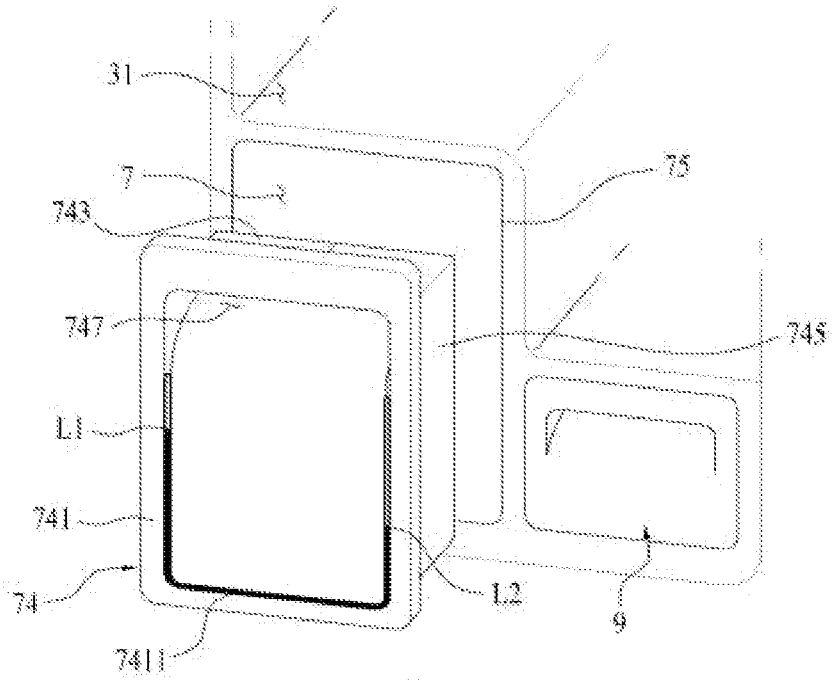
FIG. 6 is a view showing a door of the machinery compartment.
Figure 6:
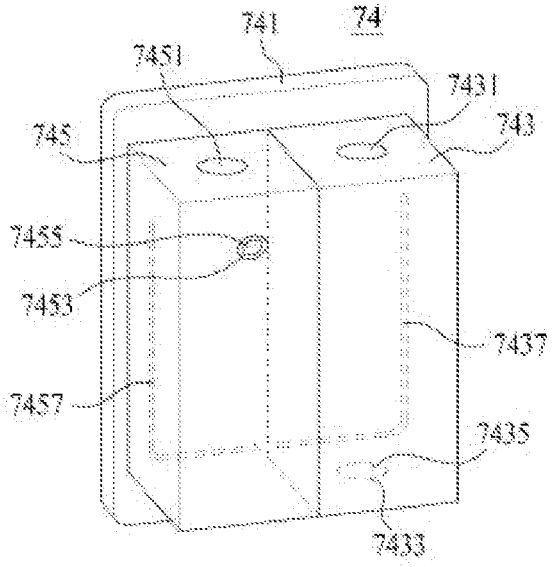

The storage unit 721 may be provided with a water supply unit 723 coupled to a water supply tank 743 (see FIG. 6) provided at a machinery compartment door 74 to introduce water into the storage unit 721 and a residual water discharge unit 729 to discharge water from the storage unit 721 to a drainage tank 745 (see FIG. 6).

The water supply unit 723 may include a pipe connected between the storage unit 721 and the water supply tank 743, which will be described hereinafter. The residual water discharge unit 729 may include a residual water discharge pipe 7291 connected between the storage unit 721 and the drainage tank 745, which will be described hereinafter, and a pump 7293 provided at the residual water discharge pipe 7291.

As shown in FIG. 6, the machinery compartment 7 is provided with an open side 75, through which the inside of the machinery compartment 7 communicates with the outside of the machinery compartment 7. The open side 75 is opened and closed by the machinery compartment door 74.

The machinery compartment door 74 includes a door body 741 to close the open side 75 and a water supply tank 743 detachably fixed to the door body 741 to store water.

The door body 741 is provided with a handle 747. The door body 741 may be detachably provided at the open side 75. Alternatively, the door body 741 may be hinged to the machinery compartment 7 such that the door body 741 can be rotated about the lower end of the open side 75.

The water supply tank 743 stores water to be supplied to the storage unit 721 of the water supply unit 72. The water supply tank 743 may include a water supply tank lead 7431, a drainage port 7433, and a check valve 7435.

The water supply tank lead 7431 is detachably provided at the top of the water supply tank 743 such that a user can supply water into the water supply tank 743 through the water supply tank lead 7431.

The drainage port 7433 is provided at the bottom of the water supply tank 743 such that water can be discharged from the water supply tank 743 through the drainage port 7433. The check valve 7435 is provided in the drainage port 7433. When the machinery compartment door 74 is closed, therefore, the water supply unit 723 of the water supply unit 72 is inserted into the drainage port 7433. When the water supply unit 723 is inserted into the drainage port 7433, the check valve 7435 rotates toward the interior of the water supply tank 743 to open the drainage port 7433. As a result, water from the water supply tank 743 moves to the storage unit 721 of the water supply unit 72.

Meanwhile, the door body 741 may be further provided with the drainage tank 745 to collect water from the storage unit 721 of the water supply unit 72 through the residual water discharge unit 729.

The drainage tank 745 may be detachably provided at the door body 741. The drainage tank 745 may include a drainage tank lead 7451, an inlet port 7453, into which the residual water discharge pipe 7291 is inserted, and a check valve 7455 provided in the inlet port 7453.

The inlet port 7453 is provided at the upper part of the drainage tank 745. When the door body 741 closes the open side 75, the residual water discharge pipe 7291 of the residual water discharge unit 729 is inserted into the inlet port 7453. When the residual water discharge pipe 7291 is inserted into the inlet port 7453, the check valve 7455 rotates toward the interior of the drainage tank 745 to open the inlet port 7453.

Meanwhile, the machinery compartment door 74 may be further provided with water level checking units 7411, 7437, and 7457, through which a water level L1 of the water supply tank 743 and a water level L2 of the drainage tank 745 can be checked from outside the machinery compartment door 74.

The water level checking units 7411, 7437, and 7457 may include a body through hole 7411 formed through the door body 741, a water supply tank window 7437 provided in the height direction of the water supply tank 743 such that the water level of the water supply tank 743 can be checked through the water supply tank window 7437, and a drainage tank window 7457 provided in the height direction of the drainage tank 745 such that the water level of the drainage tank 745 can be checked through the drainage tank window 7457.

In this case, the body through hole 7411 may be provided at a position corresponding to the water supply tank window 7437 and the drainage tank window 7457. As shown in FIG. 6(*a*), the body through hole 7411 may be provided along the edge of the door body 741.

In a case in which the water supply tank 743 and the drainage tank 745 are formed of a transparent material, however, the water supply tank window 7437 and the drainage tank window 7457 may be omitted.

Meanwhile, the machinery compartment 7 may be further provided with a condensed water collection unit 73 to supply the condensed water generated by the evaporator E to the drainage tank 745.

Figure 7:
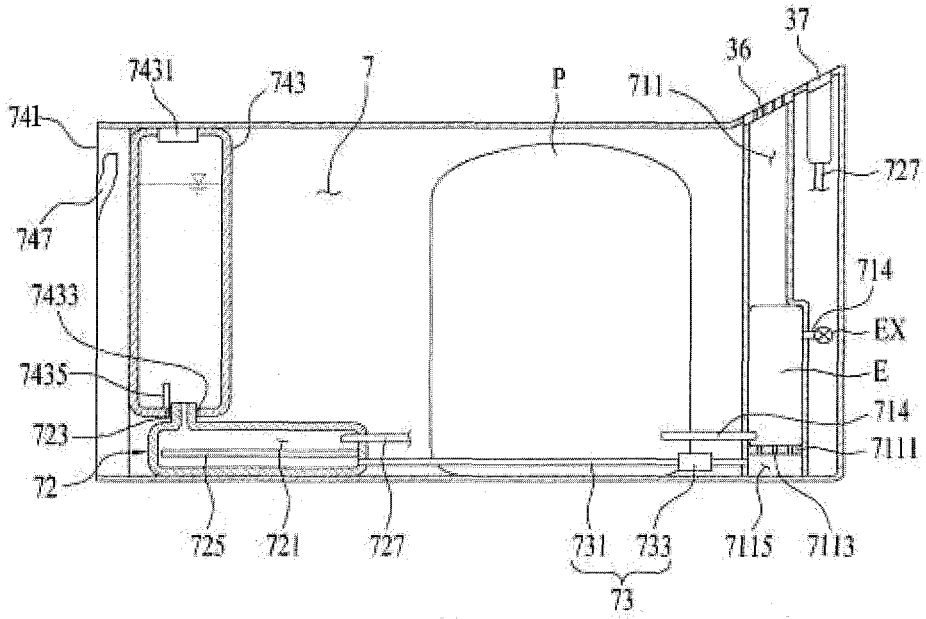
FIGS. 7 to 9 are views showing the internal structure of the machinery compartment.
Figure 7:
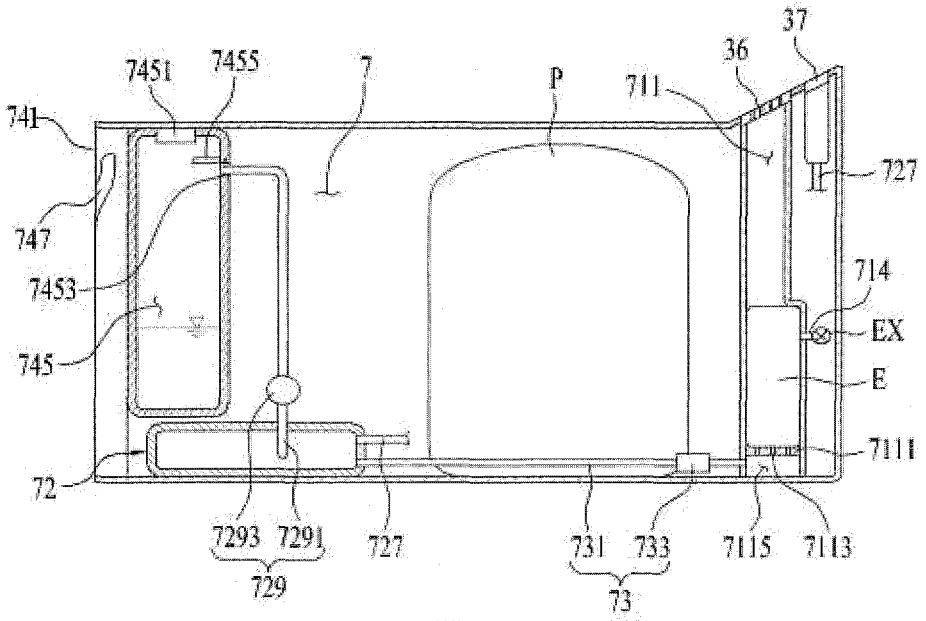

The condensed water collection unit 73 may be provided to directly interconnect the circulation duct 711 and the drainage tank 745. Alternatively, as shown in FIG. 7, the condensed water collection unit 73 may include a collection pipe 731 to interconnect the circulation duct 711 and the storage unit 721 and a collection pump 733 provided at the collection pipe 731.

This is because the condensed water generated by the evaporator E is moved to the drainage tank 745 using the pump 7293 provided at the residual water discharge unit 729, thereby simplifying the internal structure of the machinery compartment 7.

In this case, a condensed water storage unit may be provided in the circulation duct 711. The condensed water storage unit may include a support plate 7111 to support the evaporator E, a through hole 7113 formed through the support plate 7111, and a water collection unit 7115 provided below the support plate 7111 to store condensed water, the collection pipe 731 being connected to the water collection unit 7115.

Consequently, a controller (not shown) may not only control the pump 7293 to drain residual water from the storage unit 721 to the drainage tank 745 but also control the collection pump 733 and the pump 7293 to drain the condensed water generated by the evaporator E to the drainage tank 745.

As shown in FIG. 7, the compressor P may be provided between the circulation duct 711 and the door body 741. Alternatively, as shown in FIG. 8, the compressor P and the circulation duct 711 may be stacked in the height direction of the machinery compartment 7.

Figure 8:
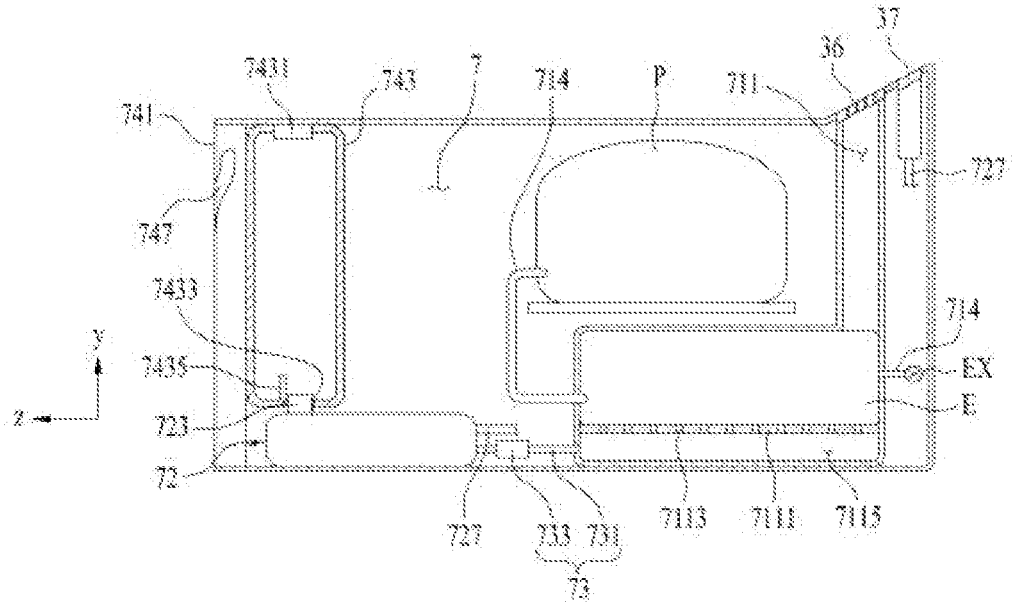
Figure 8:
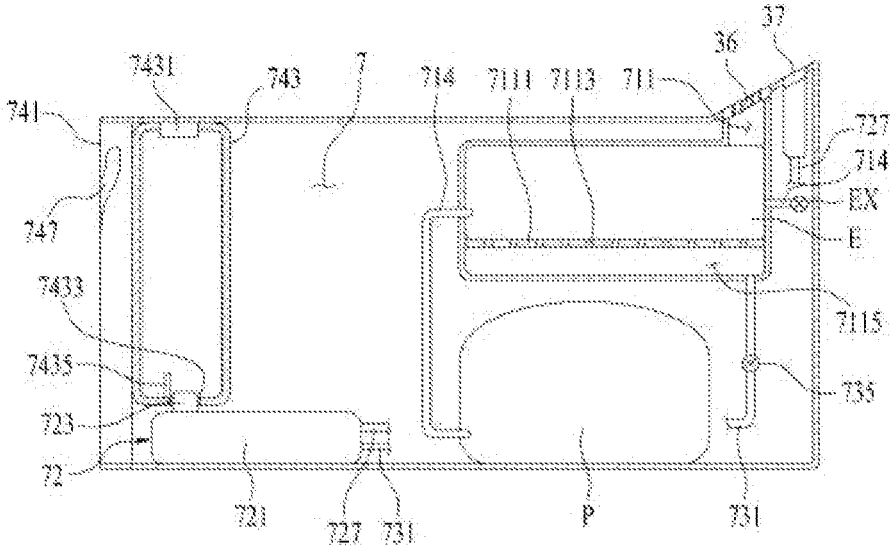

As shown in FIG. 8(*a*), the compressor P may be fixed in the machinery compartment 7 such that the compressor P is located above the circulation duct 711 in a state in which the compressor P is spaced apart from the circulation duct 711 by a predetermined distance (to prevent vibration generated from the compressor P from being transferred to the circulation duct 711). Alternatively, as shown in FIG. 8(*b*), the compressor P may be fixed in the machinery compartment 7 such that the compressor P is located below the circulation duct 711 in a state in which the compressor P is spaced apart from the circulation duct 711 by a predetermined distance (to prevent vibration generated from the compressor P from being transferred to the circulation duct 711).

In the structure in which the compressor P and the circulation duct 711 are stacked in the height direction of the machinery compartment 7, a portion of the internal space of the machinery compartment 7, e.g. the longitudinal space (space of the machinery compartment 7 in the z-axis direction), may be secured. As a result, various devices necessary to treat laundry may be further provided in the machinery compartment 7.

In this case, the water supply unit 72 may be provided at the bottom of the machinery compartment 7 such that the water supply unit 72 is located between the compressor P and the door body 741. In a case in which the circulation duct 711 is disposed above the compressor P as shown in FIG. 8(*b*), the condensed water collection unit 73 may include a collection pipe 731 to interconnect the water collection unit 7115 and the storage unit 721 and a valve 735 to open and close the collection pipe 731 under control of the controller (not shown).

Figure 9:
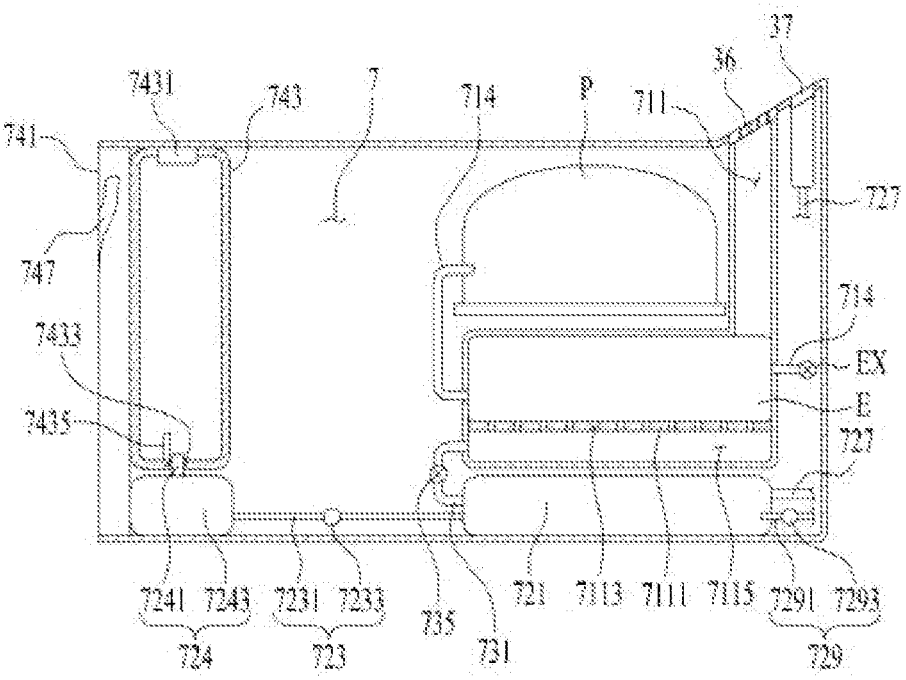

Meanwhile, the water supply unit 72 may be provided as shown in FIG. 9. That is, the circulation duct 711, the compressor P, and the storage unit 721 of the water supply unit 72 may be stacked in the height direction of the machinery compartment 7.

In this case, the condensed water collection unit 73 may include a collection pipe 731 to interconnect the water collection unit 7115 and the storage unit 721 and a valve 735 to open and close the collection pipe 731.

In addition, the water supply unit 72 may be provided such that water is supplied to the water supply unit 72 through the water supply unit 723 directly connected to the water supply tank 743. Alternatively, as shown in FIG. 9, the water supply unit 72 may be provided such that water stored in a temporary storage unit 724 is supplied to the water supply unit 72.

That is, the temporary storage unit 724, which is connected to the water supply tank 743 when the door body 741 is detached, may be provided in the machinery compartment 7. The storage unit 721 may be provided such that water stored in the temporary storage unit 724 is supplied to the storage unit 721 via a connection pipe 7231 and a connection pipe pump 7233.

The temporary storage unit 724 may include an auxiliary storage unit 7243 to store water discharged from the water supply tank 743, the connection pipe 7231 being connected to the auxiliary storage unit 7243, and a drawing pipe 7241 fitted in the drainage port 7433 of the water supply tank 743 to supply water to the auxiliary storage unit 7243.

In the above, the laundry treating apparatus 100 has been described based on the structure in which both the machinery compartment 7 and the auxiliary receiving space 9 having different heights are provided at the bottom of the receiving space 31. Alternatively, as shown in FIG. 10(*a*), the machinery compartment 7 alone may be provided the bottom of the receiving space 31.

In this case, the air discharge unit 35, the air suction unit 36, and the water discharge unit 37 may be provided at the outer circumference of the machinery compartment 7. In a case in which the air discharge unit 35 is provided at the side of the machinery compartment 7, however, air may be supplied to laundry placed between the side of the machinery compartment 7 and the inner circumference of the receiving space 31.

Although not shown, the same effect may be obtained even in a case in which the water discharge unit 37 is provided at the side of the machinery compartment 7.

Figure 10:
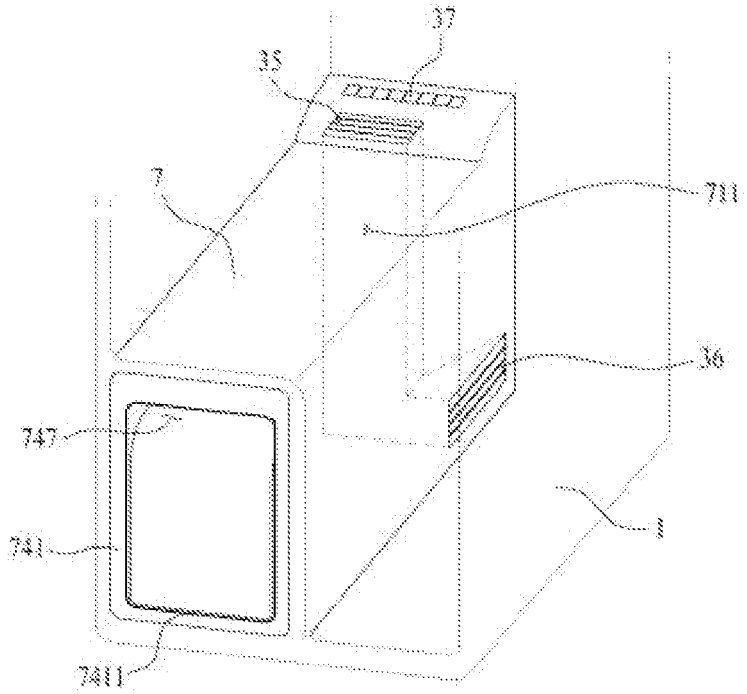
FIG. 10 is a view showing a laundry treating apparatus according to another embodiment of the present invention.
Figure 10:
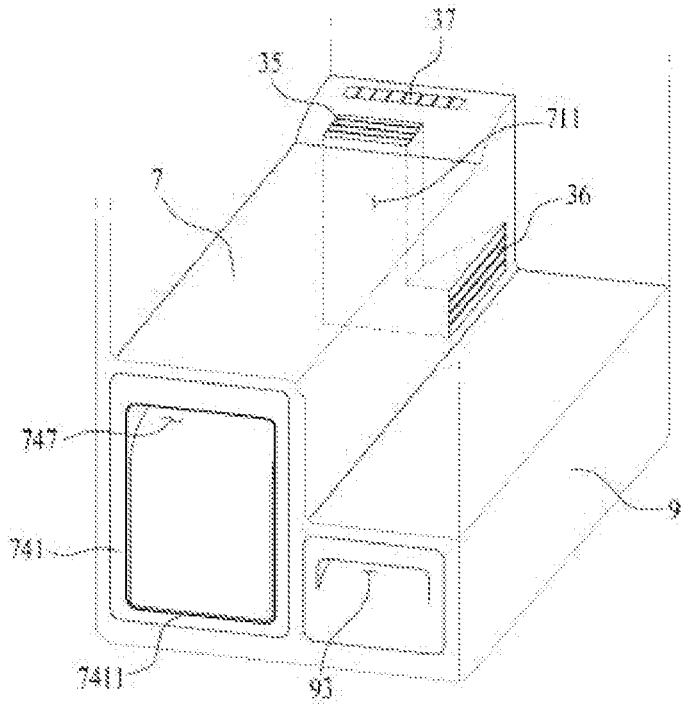

Meanwhile, in a case in which both the machinery compartment 7 and the auxiliary receiving space 9 having different heights are provided at the bottom of the receiving space 31 as shown in FIG. 10(*b*), at least one selected from between the air discharge unit 35 and the air suction unit 36 may be provided at the side of the machinery compartment 7 so as to be located at a higher position than the auxiliary receiving space 9.

As is apparent from the above description, the present invention provides a laundry treating apparatus that is capable of easily drying, deodorizing, removing wrinkles from, and sanitizing laundry.

In addition, the present invention provides a laundry treating apparatus having a receiving space to receive laundry having different lengths.

In addition, the present invention provides a laundry treating apparatus that is capable of preventing damage to laundry and reducing power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating apparatus comprising:

a cabinet having a receiving space to receive laundry;

a laundry support unit provided in the receiving space to support the laundry; and a machinery compartment located at a bottom of the receiving space to define a space separated from the receiving space, the machinery compartment provided with an air supply unit to supply air to the receiving space and a water supply unit to supply water to the receiving space; and a machinery compartment door to open and close the machinery compartment, wherein the water supply unit includes:

a storage unit provided in the machinery compartment to store water;

a heater provided in the storage unit; and a water supply pipe to interconnect an interior of the storage unit and an interior of the receiving space, and wherein the machinery compartment door includes:

a door body to open and close the machinery compartment; and a water supply tank provided at the door body such that, when the door body closes the machinery compartment, the water supply tank is coupled to the storage unit to supply water to the storage unit.

2. The laundry treating apparatus according to claim 1, wherein the machinery compartment has a smaller width than the receiving space to define a space to receive the laundry held by the laundry support unit between an outer circumference of the machinery compartment and an inner circumference of the receiving space.

3. The laundry treating apparatus according to claim 1, wherein the machinery compartment is provided to define the bottom of the receiving space such that a step is formed at the bottom of the receiving space.

4. The laundry treating apparatus according to claim 1, wherein the machinery compartment door further includes a drainage tank provided at the door body, and the water supply unit further includes a residual water discharge unit configured such that, when the machinery compartment door closes the machinery compartment, the residual water discharge unit is connected to the drainage tank to discharge water stored in the storage unit to the drainage tank.

5. The laundry treating apparatus according to claim 4, wherein the water supply tank further includes a water supply tank window provided in a height direction of the water supply tank such that a water level of the water supply tank can be checked through the water supply tank window, the drainage tank further includes a drainage tank window provided in a height direction of the drainage tank such that a water level of the drainage tank can be checked through the drainage tank window, and the door body further includes a body through hole provided at a position that corresponds to the water supply tank window and the drainage tank window.

6. The laundry treating apparatus according to claim 4, further comprising:

a circulation duct provided in the machinery compartment to circulate air in the receiving space; and a condensed water collection unit to supply condensed water stored in the circulation duct to the storage unit.

7. The laundry treating apparatus according to claim 1, further comprising an auxiliary receiving space, having a smaller height than the machinery compartment, provided in a space defined between an outer circumference of the machinery compartment and an inner circumference of the receiving space to provide a storage space.

8. The laundry treating apparatus according to claim 7, further comprising:

a circulation duct provided in the machinery compartment to circulate air in the receiving space;

an air suction unit provided at one selected from between a rear of the machinery compartment and a rear of the auxiliary receiving space; and an air discharge unit provided at the other selected from between the rear of the machinery compartment and the rear of the auxiliary receiving space, wherein the circulation duct is provided to interconnect the air suction unit and the air discharge unit.

9. The laundry treating apparatus according to claim 1, wherein the laundry support unit is reciprocatingly provided in the receiving space.

10. The laundry treating apparatus according to claim 1, wherein the machinery compartment divides the receiving space into two spaces configured such that at least one of height and width of one of the spaces is different from that of the other space.

11. The laundry treating apparatus according to claim 1, wherein the air supply unit includes:

a circulation duct provided in the machinery compartment to circulate air in the receiving space;

an evaporator provided in the circulation duct to dehumidify air introduced into the circulation duct;

a condenser provided in the circulation duct to heat the air that has passed through the evaporator; and a compressor provided outside the circulation duct to circulate a refrigerant along the evaporator and the condenser, wherein the compressor and the circulation duct are stacked in a height direction of the machinery compartment.

12. The laundry treating apparatus according to claim 11, further comprising:

an air suction unit, provided at a rear of the machinery compartment such that the air suction unit communicates with the circulation duct, through which air from the receiving space is introduced into the circulation duct; and an air discharge unit, provided at a rear of the machinery compartment such that the air discharge unit communicates with the circulation duct, through which the air is discharged from the circulation duct.

13. The laundry treating apparatus according to claim 11, wherein the storage unit is provided in a space defined between the compressor and the door body.

14. The laundry treating apparatus according to claim 11, wherein the storage unit, the circulation duct, and the compressor are stacked in the height direction of the machinery compartment.

15. The laundry treating apparatus according to claim 11, wherein the compressor is provided above or below the circulation duct.

* * * * *